US011647330B2

(12) United States Patent
Chang et al.

(10) Patent No.: US 11,647,330 B2
(45) Date of Patent: May 9, 2023

(54) TRANSDUCER APPARATUS EMBODYING NON-AUDIO SENSORS FOR NOISE-IMMUNITY

(71) Applicant: AUDIO ZOOM PTE LTD, Singapore (SG)

(72) Inventors: Joseph Sylvester Chang, Singapore (SG); Yin Sun, Singapore (SG); Sebastian Mingjie Chang, Canberra (AU); Chai Lung Lee, Singapore (SG); Tong Ge, Singapore (SG)

(73) Assignee: AUDIO ZOOM PTE LTD, Singapore (SG)

( * ) Notice: Subject to any disclaimer, the term of this patent is extended or adjusted under 35 U.S.C. 154(b) by 0 days.

(21) Appl. No.: 17/268,240

(22) PCT Filed: Aug. 12, 2019

(86) PCT No.: PCT/SG2019/050396
§ 371 (c)(1),
(2) Date: Feb. 12, 2021

(87) PCT Pub. No.: WO2020/036534
PCT Pub. Date: Feb. 20, 2020

(65) Prior Publication Data

US 2021/0314700 A1 Oct. 7, 2021

(30) Foreign Application Priority Data

Aug. 13, 2018 (SG) ..... 10201806818P

(51) Int. Cl.
*H04R 3/00* (2006.01)
*G10L 25/51* (2013.01)
(Continued)

(52) U.S. Cl.
CPC ..... *H04R 3/005* (2013.01); *G10L 25/51* (2013.01); *H04R 1/04* (2013.01); *H04R 1/326* (2013.01);
(Continued)

(58) Field of Classification Search
CPC ..... H04R 3/005; H04R 1/04; H04R 1/326; H04R 1/406; H04R 2201/401; H04R 2410/05; H04R 2499/11; G10L 25/51
(Continued)

(56) References Cited

U.S. PATENT DOCUMENTS 3,787,641 A 1/1974 Santori
4,607,383 A 8/1986 Ingalls
(Continued)

FOREIGN PATENT DOCUMENTS

EP 3035702 A1 6/2016
WO 2020036534 A1 2/2020

OTHER PUBLICATIONS

Yan, Gyrophone: Recognizing Speech from Gyroscope signals,2014.*

(Continued)

*Primary Examiner* — William A Jerez Lora

(57) ABSTRACT

The invention relates to a transducer apparatus to provide audio sensing with high noise immunity in an acoustically-noisy environment. The invention replaces the prior-art acoustic microphone with a non-acoustic sensor to sense free-field and/or surface vibrations or movement that resemble or arising from the voice of the user. The non-acoustic sensor includes an accelerometer, shock sensor, gyroscope, vibration microphone, or vibration sensor. There are several adaptions and embodiments of the invention including improving the polar directivity of the non-acoustic
(Continued)

(a) (b)

sensors and application of a multiplicity of non-acoustic sensors and acoustic microphones.

23 Claims, 7 Drawing Sheets

(51) Int. Cl.
*H04R 1/04* (2006.01)
*H04R 1/32* (2006.01)
*H04R 1/40* (2006.01)

(52) U.S. Cl.
CPC ..... *H04R 1/406* (2013.01); *H04R 2201/401* (2013.01); *H04R 2410/05* (2013.01); *H04R 2499/11* (2013.01)

(58) Field of Classification Search
USPC .... 381/91, 92, 111–115, 122, 171, 175, 313, 381/355, 369
See application file for complete search history.

(56) References Cited

U.S. PATENT DOCUMENTS 5,282,253 A 1/1994 Konomi
6,151,967 A * 11/2000 McIntosh ..... G01D 5/2417 361/283.4
7,970,148 B1 * 6/2011 Remington ..... G10K 11/17861 381/71.7
9,332,368 B1 5/2016 Hershenson
9,363,596 B2 6/2016 Dusan et al.
9,767,817 B2 9/2017 Glebe
2004/0165735 A1 * 8/2004 Opitz ..... H04R 29/006 381/92
2005/0244020 A1 11/2005 Nakajima
2009/0129620 A1 * 5/2009 Tagawa ..... H04R 3/005 381/364
2009/0190776 A1 * 7/2009 Reining ..... H04R 3/005 381/92
2010/0172519 A1 7/2010 Kimura
2012/0039499 A1 * 2/2012 Ryan ..... H04R 1/222 381/369
2013/0279734 A1 * 10/2013 Klein ..... H04R 1/02 381/395
2014/0364171 A1 * 12/2014 Heiman ..... H04M 1/605 455/566
2016/0295328 A1 * 10/2016 Park ..... H04R 19/04
2017/0125032 A1 5/2017 Sorensen

OTHER PUBLICATIONS

Foreign Communication from a Related Counterpart Application, International Search Report and Written Opinion dated Jan. 21, 2020, International Application No. PCT/SG2019/050396 filed on Aug. 12, 2019.

* cited by examiner

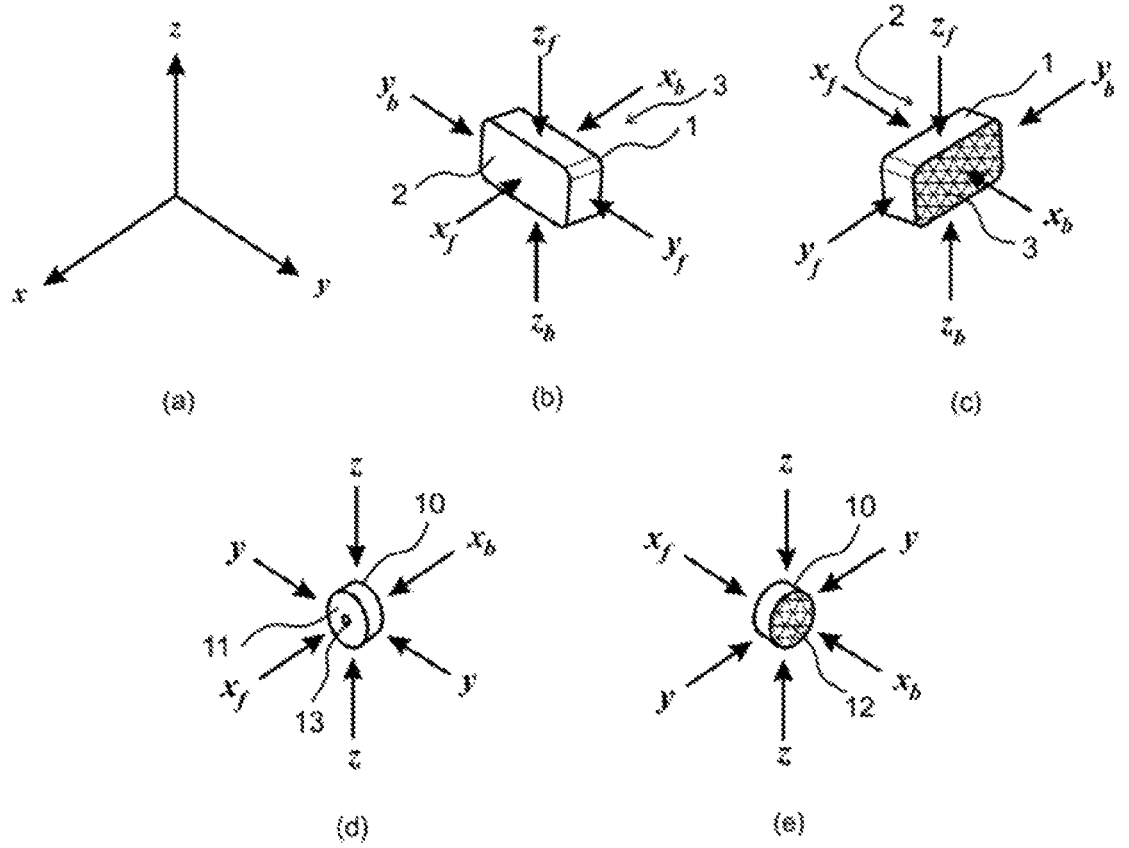
Fig. 1 (Prior-Art)
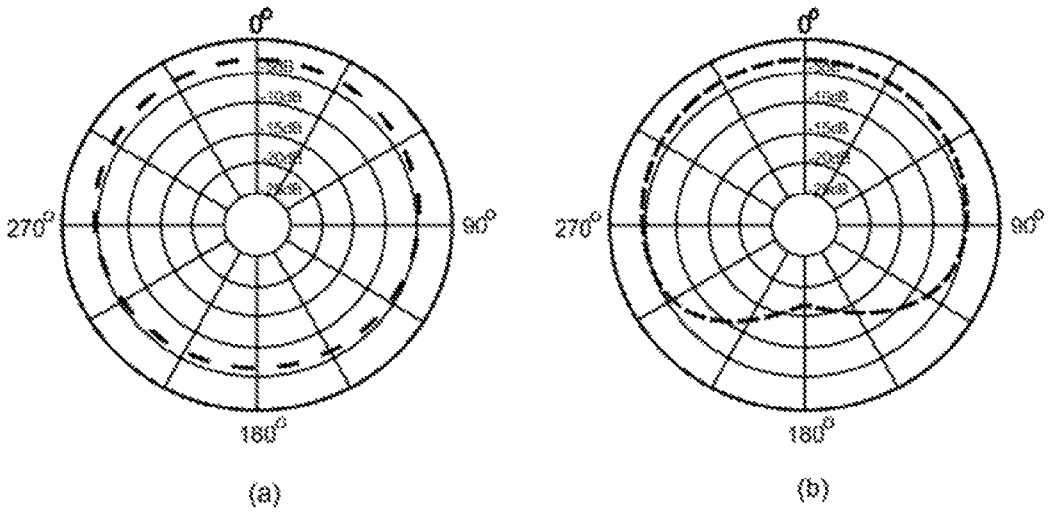
Fig. 2 (Prior-Art)

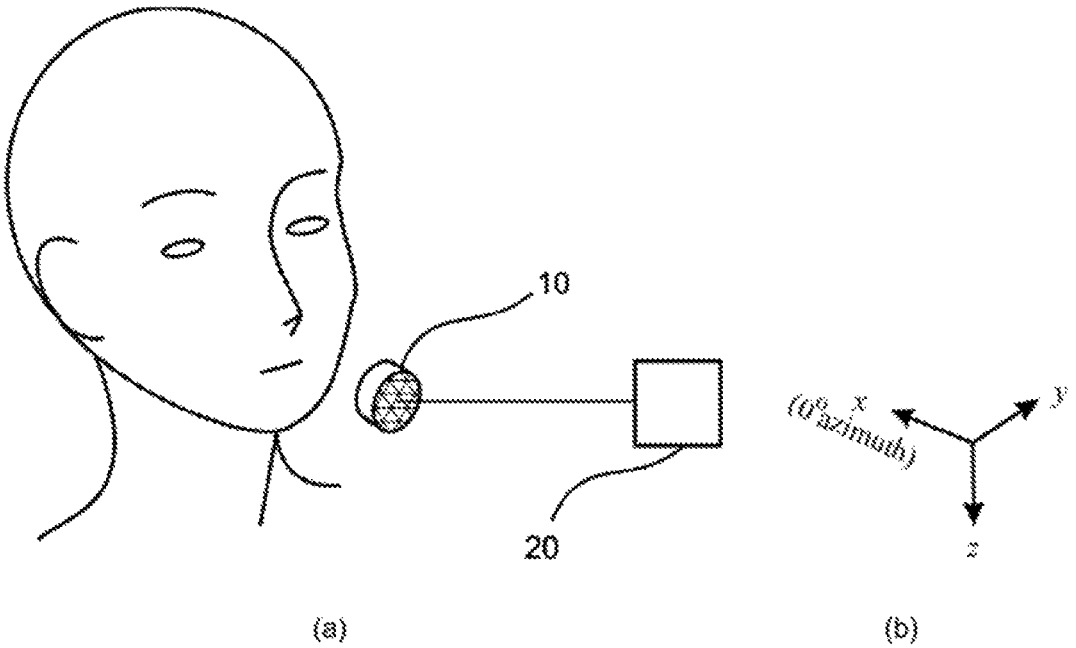
Fig. 3 (Prior-Art)
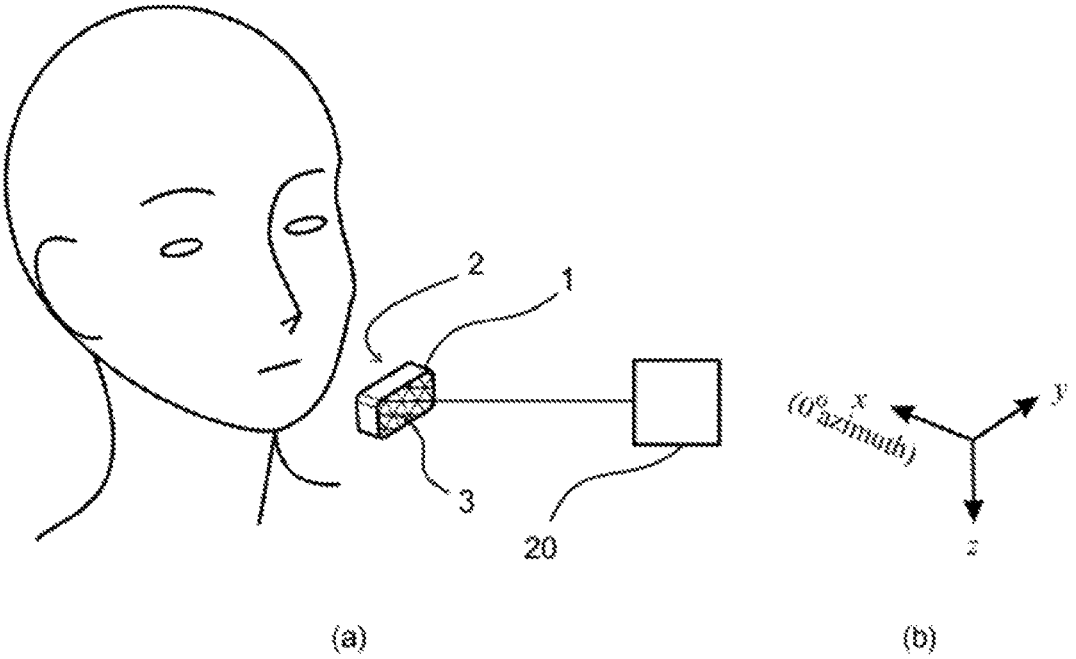
Fig. 4

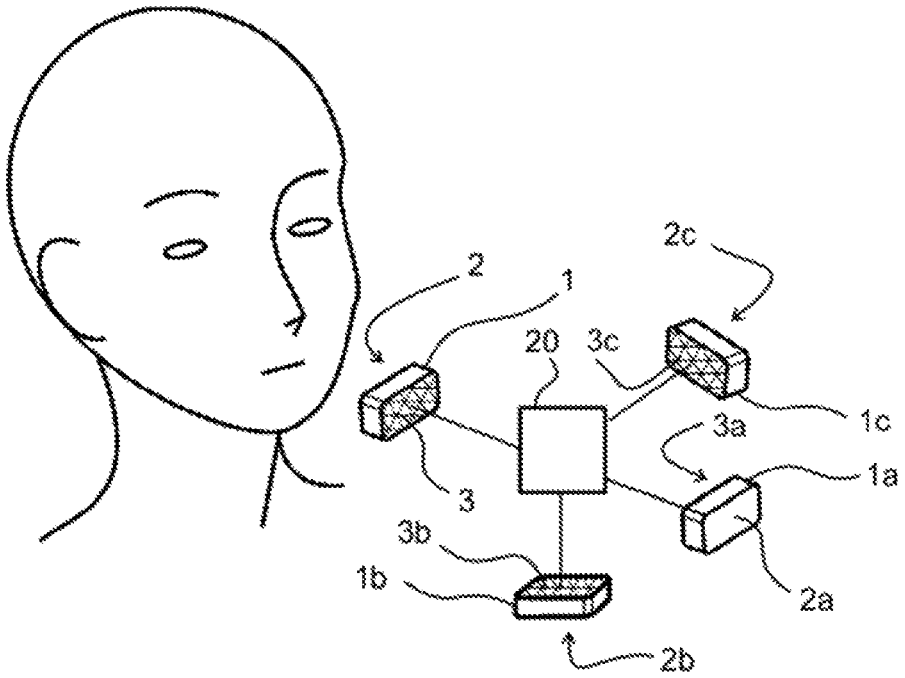
(d)
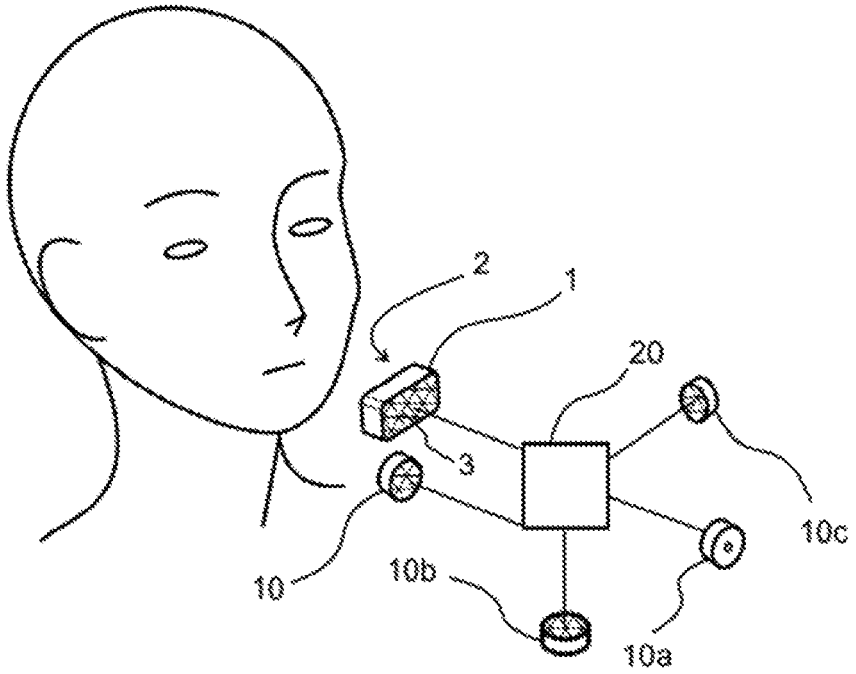
(e)
Fig. 7

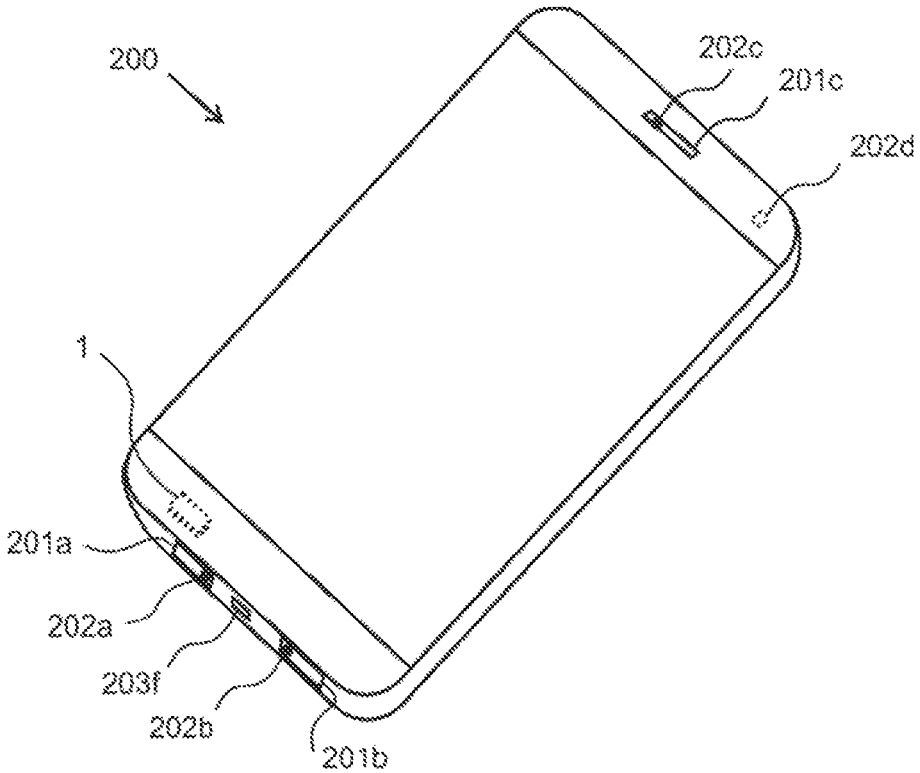
(a)
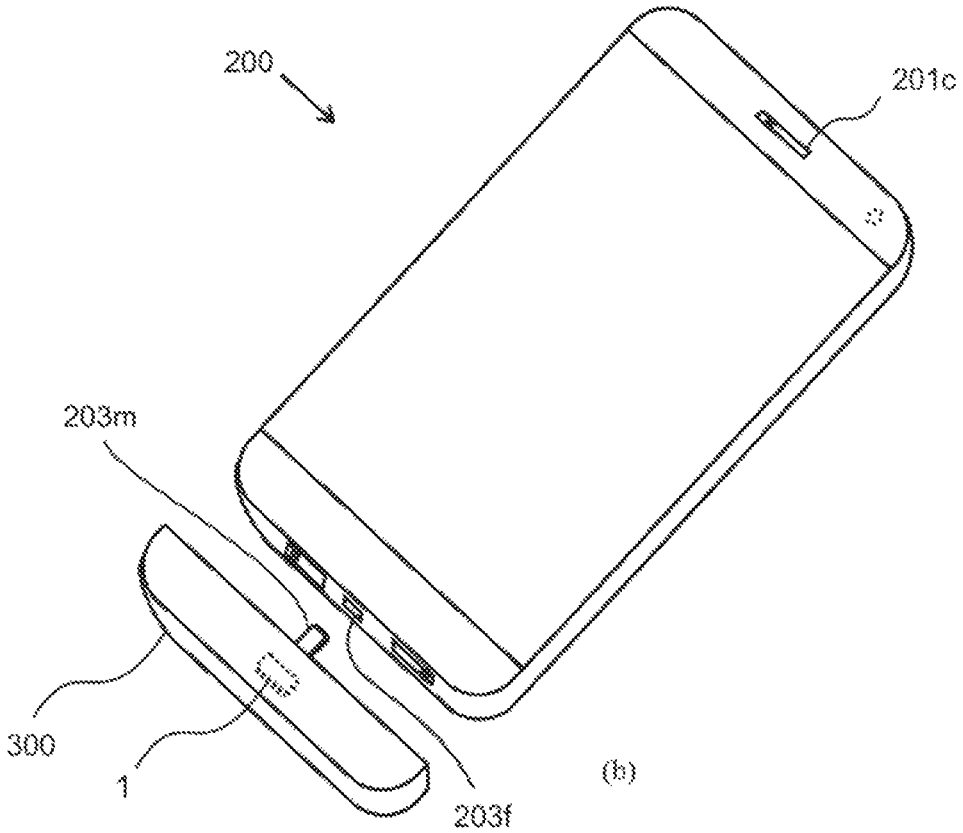
(b)
FIG. 8

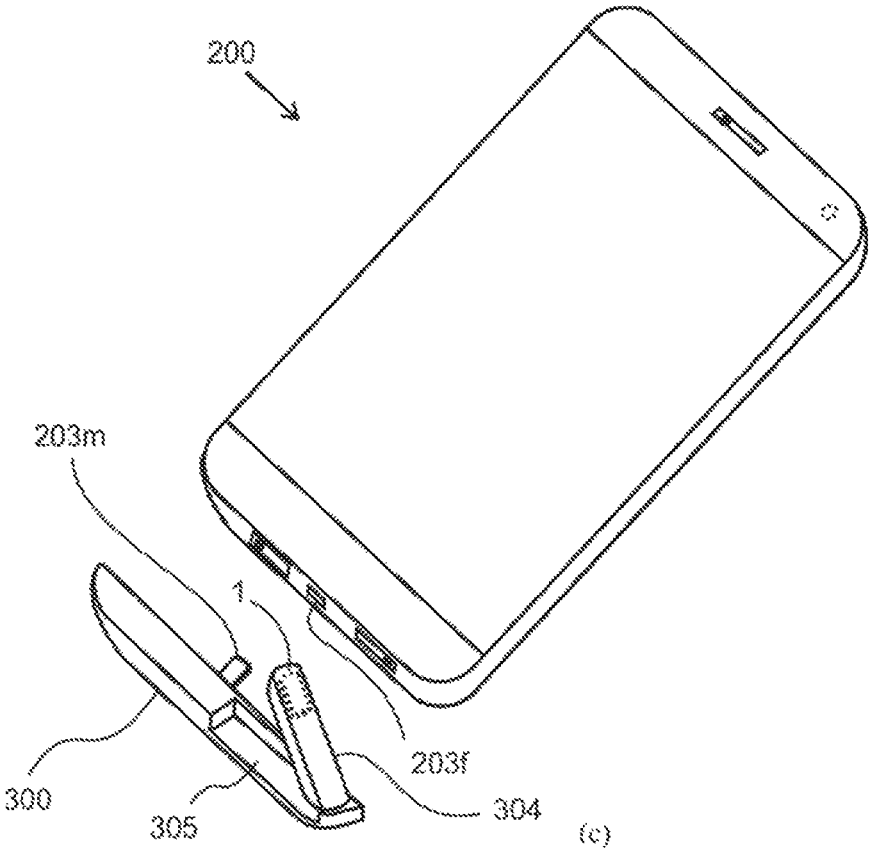
(c)
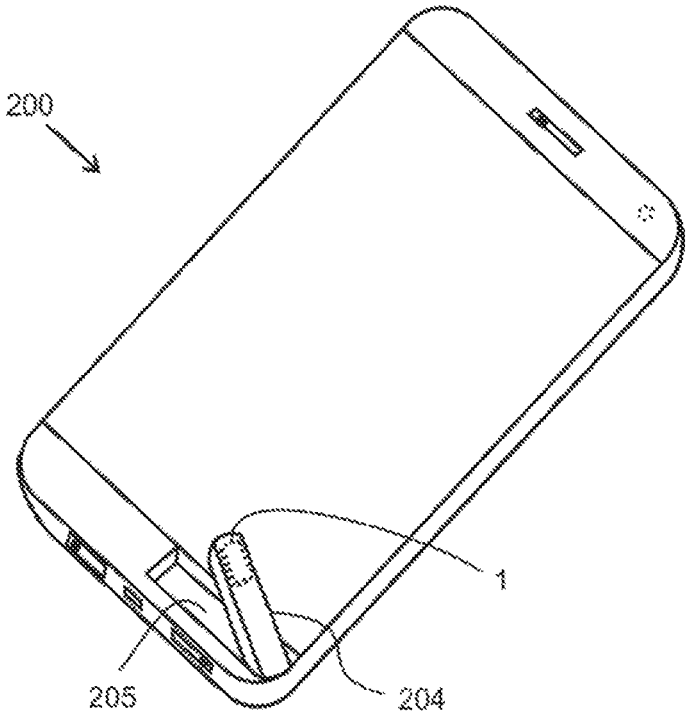
(d)
FIG. 8

TRANSDUCER APPARATUS EMBODYING NON-AUDIO SENSORS FOR NOISE-IMMUNITY

CROSS-REFERENCE TO RELATED APPLICATIONS

The present application is a filing under 35 U.S.C. 371 as the National Stage of International Application No. PCT/SG2019/050396, filed Aug. 12, 2019, entitled "TRANSUCER APPARATUS EMBODYING NON-AUDIO SENSORS FOR NOISE-IMMUNITY," which claims priority to Singapore Application No. SG 10201806818P filed with the Intellectual Property Office of Singapore on Aug. 13, 2018, both of which are incorporated herein by reference in their entirety for all purposes.

BACKGROUND OF THE INVENTION

1. Field of the Invention

Embodiments of the invention generally relate to the application and adaptations to a non-acoustic sensor as alternative microphone means to sense free-field sounds and to be placed on any part of the user's head to obtain high speech intelligibility in noisy environments.

2. Description of the Related Art

It is difficult to obtain high speech-intelligibility/noise immunity in acoustically-noisy environments. High noise immunity is high signal-to-noise ratio where the signal is the user's voice and the noise is the ambient environmental noise. Prior-art inventions that improve noise immunity include employing an array of microphones to sense free-field sounds or/and a non-acoustic sensor such as the accelerometer placed on the boney part (skull, temple or mastoid) or throat of the user's head or in his ear (concha) to sense vibrations, and signal processing. The latter in general yields poor audio quality. In electronic devices, e.g., a smartphone or tablet, the prior-art application of the non-acoustic sensor therein is for ascertaining movement direction and/or navigation.

Put simply, there is no prior-art application of the non-acoustic sensor to sense free-field acoustics (sounds).

Further, there is no prior-art means of adapting the non-acoustic sensor to improve its polar directivity to free-field acoustics.

A commonality of all prior-art noise suppression techniques/apparatus is the employment of one or more prior-art acoustic microphones or an accelerometer to sense vibrations on selected parts of the user's head. Nevertheless, the noise immunity remains insufficient, including insufficient directivity, costs and form factor, complex signal processing, etc. In short, there is a need to ascertain inventions means to obtain better noise immunity and address the aforesaid shortcomings of prior-art inventions.

SUMMARY OF THE INVENTION

Generally, the invention relates to a transducer apparatus to provide audio sensing with high noise immunity in an acoustically-noisy environment, thereby providing high speech intelligibility. This invention involves replacing the prior-art acoustic microphone with a non-acoustic sensor, including an accelerometer, shock sensor, gyroscope, vibration microphone, or vibration sensor, and the combinations of the non-acoustic sensor(s) with acoustic microphones. The embodiments of the invention is an application of the non-acoustic sensor is to sense vibrations or movement in free-field (not on a surface as prior-art), to improve the polar directivity of the non-acoustic sensor, to employ the non-acoustic sensor with other non-acoustic sensors and acoustic microphone, and to employ non-acoustic sensors in an innovative fashion to sense vibrations on or movement near the skin.

In the first embodiment, the non-acoustic sensor replaces the acoustic microphone to sense free-field acoustics. In the second embodiment, the sensitivity of one side of the non-acoustic sensor is adapted to be different from the other side. In the third embodiment, multiple transducers are adapted to provide higher directivity and/or noise suppression. In the fourth embodiment, the non-acoustic sensor placed within the enclosure of an electronic device or its attachment. There are several adaptations in each of the four embodiments of the invention.

The summary does not describe an exhaustive list of all aspects of the present invention. It is anticipated that the present invention includes all methods, apparatus and systems that can be practiced from all appropriate combinations and permutations of the various aspects in this summary, as well as that delineated below. Such combinations and permutations may have specific advantages not specially described in this summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention herein are not necessarily to the same embodiment, and they mean at least one.

FIG. 1A to 1E depicts the definition of the spatial 3-axes for the orientation of a non-acoustic sensor (accelerometer, shock sensor, gyroscope, vibration microphone, vibration sensor) and an acoustic microphone. This includes the front and back directions of these 3-axes.

FIGS. 2A and 2B depicts the polar response plots of prior-art omni-directional and cardioid acoustic microphones.

FIGS. 3A and 3B depicts a prior-art application of an acoustic microphone placed close to the mouth of a user and connected to an electronic device.

FIGS. 4A and 4B depicts the first embodiment of the invention where a non-acoustic sensor is placed close to the mouth of a user and connected to an electronic device.

FIG. 8A to 8D depicts the fourth embodiment of the invention where various adaptation means are invented to sense vibrations arising the user's voice by means of a non-acoustic sensor(s) in the electronic device or its attachment.

DETAILED DESCRIPTION

Figure 5:
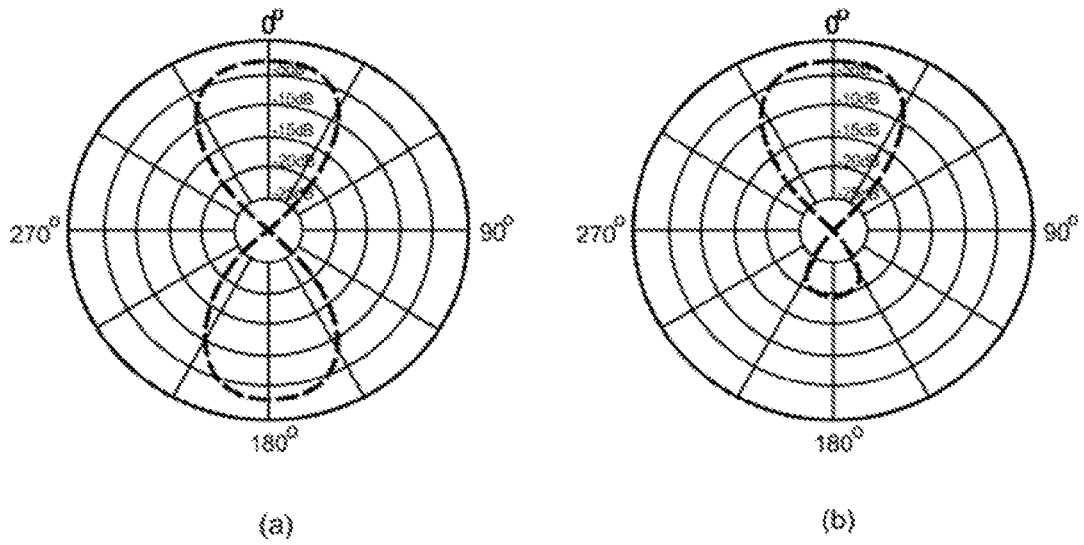
FIGS. 5A and 5B depicts the polar plots of a single-axis non-acoustic sensor and another whose sensitivity in one direction is less sensitive than the opposite direction.

Numerous specific details are set forth in the following descriptions. It is however understood that embodiments of the invention may be practiced with or without these specific details. In other instances, circuits, structures, methods and techniques that are known do not avoid obscuring the understanding of this description. Furthermore, the following embodiments of the invention may be described as a process, which may be described as a flowchart, a flow diagram, a structure diagram, or a block diagram. The operations in the flowchart, flow diagram, structure diagram or block diagram may be a sequential process, parallel or concurrent process, and the order of the operations may be re-arranged. A process may correspond to a technique, methodology, procedure, etc.

FIG. 1(*a*) depicts established definitions of the axes in three dimensions, x-axis, y-axis and z-axis. FIG. 1 (*b*) depicts the same with respect to a Non-acoustic Sensor 1 where the subscripts f and b refer to the front and back, respectively, to the surface of Non-acoustic Sensor 1. For sake of definition, 0° azimuth for a given location for the x-axis is opposite direction of $x_f$ and 180° azimuth is the opposite direction of $x_b$. Non-acoustic Sensor 1 has Front Surface 2 and Back Surface 3, and as a single-axis non-acoustic sensor, it is sensitive to movement along the x-axis. FIG. 1(*c*) depicts the same Non-acoustic Sensor 1 from a different view, with Back Surface 3 shaded. FIGS. 1(*d*) and 1(*e*) depicts the same as FIGS. 1(*b*) and 1(*c*), respectively, for an Acoustic Microphone 10 having Front Surface 11, Back Surface 12 and Acoustic Input Port 13. Also, as before, 0° azimuth for a given location for the x-axis is opposite direction of $x_f$ and 180° azimuth is the opposite direction of $x_b$. In prior-art, the non-acoustic sensor is usually an accelerometer.

FIG. 2(*a*) depicts a typical polar response of a prior-art Acoustic Microphone 10, e.g. FIGS. 1(*d*) and (*e*), whose polar response is omni-directional. FIG. 2(*b*) depicts a typical polar response of a prior-art acoustic microphone whose polar response is directional—cardioid. There are several prior-art different polar responses involving multiple acoustic microphones.

FIG. 3(*a*) depicts a prior-art application of a single Acoustic Microphone 10 connected to an Electronic Device 20. Acoustic Input Port 13 of Acoustic Microphone 10 is directed to the mouth of the user of Electronic Device 20. By definition of the 3-axes in FIG. 3(*a*), Acoustic Input Port 13 is 0° azimuth along the x-axis.

FIG. 4(*a*) depicts the first embodiment of the invention where Non-acoustic Sensor 1 is placed close to the mouth of the user of Electronic Device 20. Non-acoustic Sensor 1 is preferably a single-axis no-acoustic sensor, e.g., an accelerometer, whose internal mass movement is sensitive to the direction perpendicular to the user's mouth, along the x-axis in FIG. 4(*b*). Front Surface 2 of Non-acoustic Sensor 1 is placed in front and parallel to the surface of the user's mouth, i.e., 0° azimuth along the x-axis.

Consequent to the appropriate placement of the single-axis Non-acoustic Sensor 1, the polar response of Non-acoustic Sensor 1 as an acoustic transducer that senses sounds is depicted in FIG. 5(*a*). In FIGS. 5(*a*) and (*b*), the 0° and 180° azimuths are respectively the direction along the x-axis that is perpendicular to Front Surface 2 and Back Surface 3 of Non-acoustic Sensor 1 in FIG. 4. It can be appreciated that the polar response of Accelerator 1 is very directive—substantially more directive than the prior-art single Acoustic Microphone 10 and prior-art array of acoustic microphones.

Nevertheless, the high sensitivity of Non-acoustic Sensor 1 at 180° azimuth in FIG. 5(*a*) is undesirable. This is because in this first embodiment of the invention in FIG. 4, the signal most of the voice of the user is at 0° azimuth and most of the noise is present at 180° azimuth, i.e., both voice and noise are sensed. In other words, it desirable that the sensitivity at 180° azimuth be heavily attenuated while the sensitivity at 0° remains unchanged (or accentuated), as depicted in FIG. 5(*b*).

Figure 6:
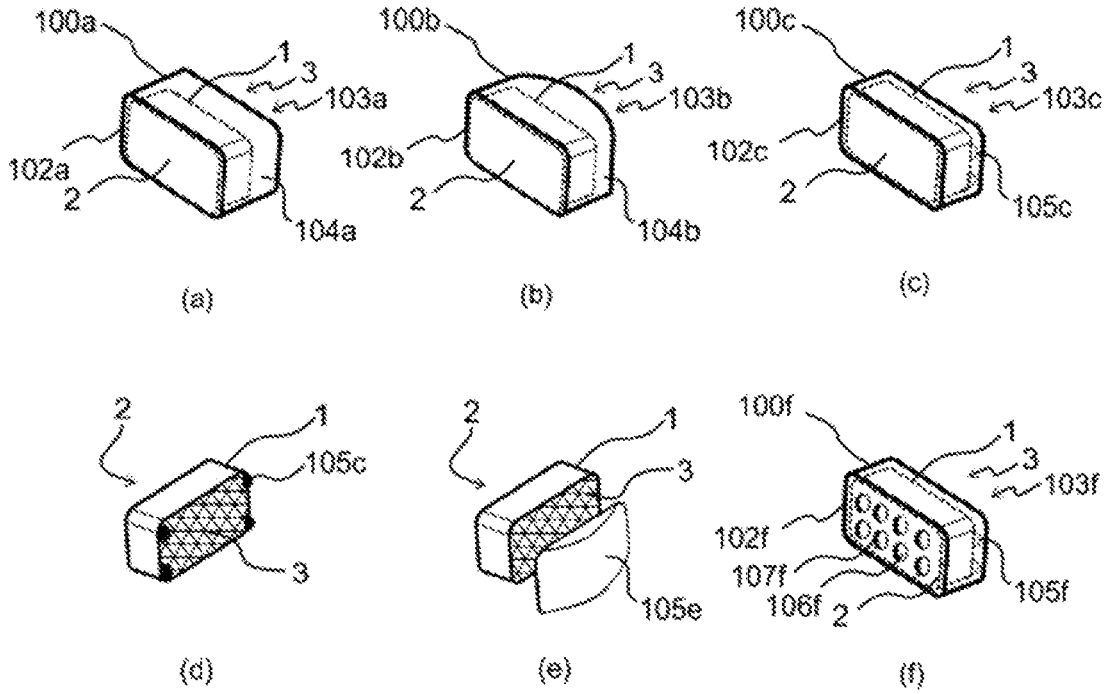
FIG. 6A to 6F depicts the second embodiment of the invention where various adaptation means are invented to obtain the polar plot of the non-acoustic sensor whose sensitivity in one direction is adapted to be less sensitive than the other opposite direction.

FIGS. 6 (*a*)-(*f*) depict the second embodiment of the invention where various adaptation means are invented to adapt the polar plot of the single-axis Non-acoustic Sensor in FIG. 5(*a*) to FIG. 5(*b*)—to obtain high polar directivity, hence noise immunity. Specifically, the four adaptations in FIGS. 6(*a*)-6(*e*) serve to reduce the sensitivity of the lobe at the 180° azimuth in FIG. 5(*b*)—the noise. The fifth adaptation in FIG. 6(*f*), on the other hand, serves to increase the sensitivity of the lobe at the 0° azimuth in FIG. 5(*b*)—the signal—and simultaneously reduce the sensitivity of the lobe at the 180° azimuth if the adaptations in FIGS. 6(*a*)-(*e*) are applied.

FIG. 6(*a*) depicts the first invented adaptation of the second embodiment of the invention. Here, Non-acoustic Sensor 1 is encapsulated in Enclosure 100*a*. Enclosure 100*a* has Enclosure Front Surface 102*a* and Enclosure Back Surface 103*a*. Front Surface 2 of Non-acoustic Sensor 1 touches inner surface of Enclosure Front Surface 102*a*, preferably mechanically adhered thereto. There is an Air Gap 104*a* (i.e., an empty space) between Back Surface 3 of Non-acoustic Sensor 1 and Enclosure Back Surface 103*a*. As before, Front Surface 2 of Non-acoustic Sensor 1 (and Enclosure Front Surface 102*a*) is placed in front and parallel to the surface of the user's mouth as depicted in FIG. 4. With respect to FIG. 5(*a*) or 5(*b*), Front Surface 2 of Non-acoustic Sensor 1 (and Enclosure Front Surface 102*a*) is 0° azimuth and Back Surface 3 of Non-acoustic Sensor 1 (and Enclosure Back Surface 103*a*) is 180° azimuth.

With respect to FIG. 4, the user's voice is at 0° azimuth and the sounds at 180° azimuth are noise in an acoustically noisy environment, along the x-axis. The noise sounds at 180° azimuth are perpendicular to (and strikes) Enclosure Back Surface 103*a*. Because an air gap now separates Enclosure Back Surface 103*a* and Back Surface 3 of Non-acoustic Sensor 1, the vibrations (arising from noise) sensed by Non-acoustic Sensor 1 at 180° azimuth is attenuated. In this fashion, this first adaptation of the second embodiment of the invention in FIG. 6(*a*) provides for the adaptation of a single-axis Non-acoustic Sensor 1 whose its original polar response in FIG. 5(*a*) is now adapted to FIG. 5(*b*). The outcome is the attenuated sensitivity of Non-acoustic Sensor 1 at 180° azimuth, hence an increasingly directive polar response.

FIG. 6(*b*) depicts the second invented adaptation of the second embodiment of the invention. This second adaptation is similar to the aforesaid first invented adaptation but with a change to the shape of the back of the enclosure. Specifically, the flat surface of Enclosure Back Surface 103*a* of Enclosure 100*a* in FIG. 6(*a*) is now made a curved surface of Enclosure Back Surface 103*b* of Enclosure 100*b* in FIG. 6(*b*). The intention here is reduce the effective surface area that contributes to the sensitivity of Non-acoustic Sensor 1 at 180° azimuth. This would further reduce the sensitivity of the 180° azimuth lobe of the polar plot in FIG. 5(*b*), hence further accentuating the directivity of the polar response.

It is obvious to one skilled in the art that there are several other adaptations to shape the Enclosure Back Surface 103*a* and 103*b* to reduce effective surface area that contributes to the sensitivity of Non-acoustic Sensor 1 at 180° azimuth. An example is to make the Enclosure Back Surface 103*a* or 103*b* hemispherical-like or pyramid-like.

FIG. 6(*c*) depicts the third invented adaptation of the second embodiment of the invention. This third invented adaptation differs from the aforesaid first and second adaptations by removing Air Gap 104*a* or 104*b* in Enclosures 100*a* and 100*b* in FIGS. 6(*a*) and 6(*b*), respectively. Instead Back Surface 3 of Non-acoustic Sensor 1 now makes contact with Enclosure Back Surface 103*c* of Enclosure 100*c* by means of Feet 105*c* made from a compliant material, such as rubber. FIG. 6(*d*) depicts the four different Feet 105*c* placed on the four corners of Back Surface 3 of Non-acoustic Sensor 1.

In this fashion, only a small portion of the vibrations arising from perpendicular noisy sounds at 180° azimuth that strikes Enclosure Back Surface 103*c* is transferred to the Back Surface 3 of Non-acoustic Sensor 1. The outcome of this third invented adaptation is the same as the aforesaid first and second invented adaptations—the sensitivity of the 180° azimuth lobe of the polar plot in FIG. 5(*b*) is attenuated, hence accentuating the directivity of the polar response.

FIG. 6(*e*) depicts the fourth invented adaptation of the second embodiment of the invention. In this adaptation, instead of having an enclosure with a back surface to attenuate the sounds striking Back Surface 3 of Non-acoustic Sensor 1, a Backing 105*e* is simply adhered to Back Surface 3 of Non-acoustic Sensor 1. In this fashion, the enclosure that embodies Non-acoustic Sensor 1 need not have a back surface, i.e., it can be an open enclosure with five surfaces with an open back. Backing 105*e* serves the same function as the Enclosure Back Surfaces 103*a*, 103*b* and 103*c* respectively in Enclosure 100*a* (FIG. 6(*a*)), 100*b* (FIG. 6(*b*)) and 100*c* (FIG. 6(*c*)).

In summary, the four adaptations in FIGS. 6(*a*)-6(*e*) serve to reduce the sensitivity of the lobe at the 180° azimuth in FIG. 5(*b*)—the noise. Consider now the fifth adaptation in FIG. 6(*f*) which conversely serves to increase the sensitivity of the lobe at the 0° azimuth in FIG. 5(*a*)—the signal.

In FIG. 6(*f*), Enclosure 100*f* has Enclosure Front Surface 102*f* and Enclosure Back Surface 103*f*. For sake of illustration, Back Surface 3 of Non-acoustic Sensor 1 makes contact to Enclosure Back Surface 103*f* by means of Feet 105*f* similar to Feet 105*c* in FIGS. 6(*c*) and 6(*d*).

To increase the sensitivity of the lobe at the 0° azimuth in FIG. 5(*b*), the effect of the sounds from the user's voice at 0° azimuth (FIG. 4) striking the Top Surface 2 of Non-acoustic Sensor 1 needs to be accentuated. This is obtained by a mechanical resonance means, for example a thin film that preferably has compliance in the direction of 0° azimuth and that is placed on the Front Surface 2 of Non-acoustic Sensor 1. In FIG. 6(*f*), sounds from the user's voice at 0° azimuth strikes this Mechanical Resonance Means 106*f* via Holes 107*f* in Enclosure Front Surface 102*f*. Because of the mechanical resonance, the ensuing mechanical vibrations on the Front Surface 2 of Non-acoustic Sensor 1 is increased, thereby increasing the sensitivity of the lobe at the 0° azimuth in FIG. 5(*b*).

Consider now the third embodiment of the invention where the first embodiment of the invention depicted in FIG. 4 is now augmented with other non-acoustic sensor(s) and acoustical microphone transducer(s). For ease of illustration, FIG. 7(*a*) depicts the reference 3-axes. Note, as before, that the 0° azimuth along the x-axis is perpendicular to the top surface of Non-Acoustic Sensor 1 and pointing to the mouth of the user.

Figure 7:
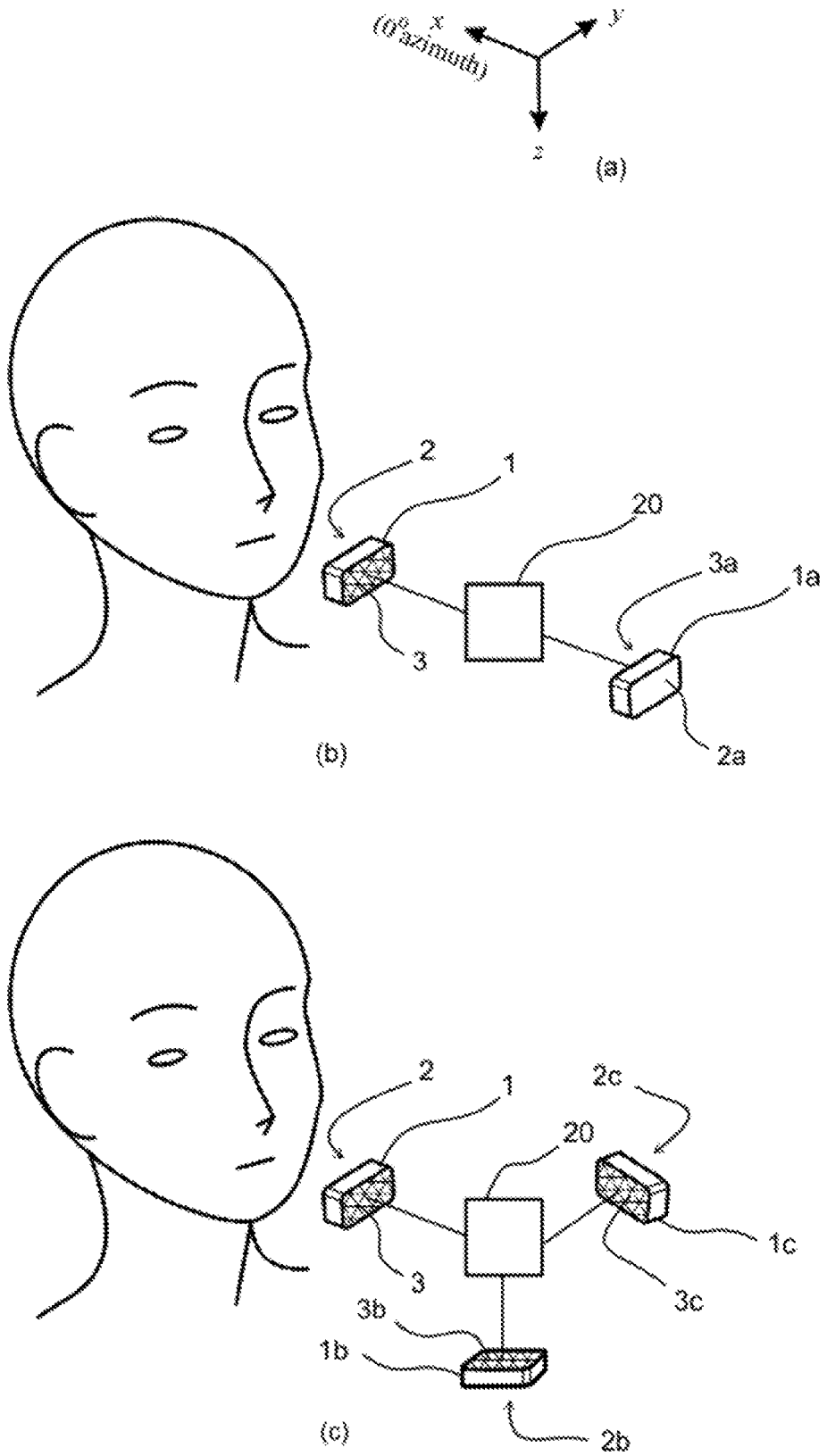
FIG. 7A to 7E depicts the third embodiment of the invention where various adaptation means are invented to combine the functionality of a non-acoustic sensor with other non-acoustic sensors and/or with acoustic microphones.

FIG. 7(*b*) depicts the first invented adaptation of the third embodiment of the invention, involving two non-acoustic sensors. The intention is to obtain high noise immunity by sensing the user's strong voice signal and weak noise signal at 0° azimuth from a first non-acoustic sensor, and sensing the strong noise signal and the user's weak voice signal at 180° azimuth from a second non-acoustic sensor. This is obtained by spatially placing the two non-acoustic sensors differently and orienting them according their directivity, preferably with the adaptions in FIGS. 6(*a*)-(*f*). Further noise immunity can be obtained by signal processing, largely by cancelling the weak noise signal sensed by the first non-acoustic sensor from the strong noise signal obtained from the second non-acoustic sensor.

In FIG. 7(*b*), the first and second single-axis non-acoustic sensors are respectively Non-acoustic Sensor 1 and Non-acoustic Sensor 1*a*. Non-acoustic Sensor 1 is arranged such that its Top Surface 2 is placed close to and in parallel to (in front of) the user's mouth, i.e., at 0° azimuth in FIG. 7(*a*) and FIG. 5(*a*). Back Surface 3 of Non-acoustic Sensor 1 is then at 180° azimuth, i.e., facing away from the user's mouth. Non-acoustic Sensor 1*b* is arranged such that Top Surface 2*a* is conversely at 180° azimuth, and its Bottom Surface 3*a* is at 0° azimuth.

The outputs of Non-acoustic Sensors 1 and 1*a* are connected to Electronic Device 20, for example a smartphone. In an example of a smartphone assembly, Non-acoustic Sensor 1 may be placed at the bottom of the smartphone with Top Surface 2 placed parallel or at 45° to its screen side (top side); see FIG. 8(*a*) later for a parallel placement. Non-acoustic Sensor 1*a*, on the other hand, may be placed on the top of the smartphone with Top Surface 2*a* placed parallel or at 45° to the back surface of the smartphone.

The acoustical signal sensed by Non-acoustic Sensor 1 is mostly the user's voice from 0° azimuth and some noise at 180° azimuth. This is because Non-acoustic Sensor 1 is placed close to the user's mouth. The high directivity from Non-acoustic Sensor 1 provides some noise immunity. The acoustical signal sensed by Non-acoustic Sensor 1*a*, on the other hand, is mostly noise from 180° azimuth and some voice because it is relatively far from the user's mouth. By means of signal processing in Electronic Device 20 where some noise sensed by Non-acoustic Sensor 1 is cancelled by the mostly noise sensed from Non-acoustic Sensor 1*a*, high noise immunity is obtained.

In a slightly modified first adaptation of the third embodiment of the invention, the noise sensed by Non-acoustic Sensor 1 at 180° azimuth can be reduced by one or more of the invented adaptations of the second embodiment of the invention depicted in FIGS. 6(*a*)-6(*f*). In this fashion, the acoustical signal sensed by Non-acoustic Sensor 1 is mostly the user's voice from 0° azimuth and very little noise at 180° azimuth—the noise is much smaller than in the aforesaid first adaptation of the third embodiment of the invention. By the same means, the acoustical signal sensed by Non-acoustic Sensor 1*a*, conversely, is mostly noise from 180° azimuth and very little voice from 0° azimuth. Higher noise immunity can be obtained by signal processing, where the very little noise sensed by Non-acoustic Sensor 1 is cancelled by the mostly noise sensed from Non-acoustic Sensor 1*a*.

FIG. 7(*c*) depicts the second adaptation of the third embodiment of the invention involving three single-axis non-acoustic sensors, Non-acoustic Sensor 1, Non-acoustic Sensor 1*b* and Non-acoustic Sensor 1*c*. The intention of this adaptation is to suppress noise in the direction of the two axes perpendicular to the axis of the user's voice. For example, with respect to orientations defined in FIG. 7(*a*), the voice is along the x-axis while the noise is in the y- and z-axes. One single-axis non-acoustic sensor is used for each axis.

Non-acoustic Sensor 1, Non-acoustic Sensor 1*b* and Non-acoustic Sensor 1*c* respectively senses signals along the x-axis, z-axis and y-axis. As the user's voice is at 0° azimuth in front of Front Surface 2 and noise at 180° azimuth of the x-axis, Non-acoustic Sensor 1 senses both voice and noise—see FIG. 5(*a*). Non-acoustic Sensor 1*b*, with its Front Surface 2*b* and Back Surface 3*b* oriented to the z-axis, senses mostly noise along the z-axis. Non-acoustic Sensor 1*c*, with its Front Surface 2*c* and Back Surface 3*c* oriented to they-axis, senses mostly noise along they-axis.

The outputs of the three non-acoustic sensors are connected to electronic device 20. The signal processing involves cancelling/reducing the noise in the signals from Non-acoustic Sensor 1 from the noise signals obtained from Non-acoustic Sensors 1*b* and 1*c*, hence high noise immunity.

Note that it may not be necessary to use three independent single-axis non-acoustic sensors in this second adaptation of the third embodiment of the invention. Instead, one 3-axes non-acoustic sensor that is sensitive to three independent axes may be used.

In a slightly modified second adaptation of the third embodiment of the invention, the noise sensed by Non-acoustic Sensor 1 at 180° azimuth can be reduced by one or more of the invented adaptations of the second embodiment of the invention depicted in FIG. 6(*a*)-6(*f*). By this means, the signal sensed by Non-acoustic Sensor 1 is mostly voice at 0° azimuth with a small amount of noise at 180° azimuth along the x-axis, and Non-acoustic Sensors 1*b* and 1*c* sensing mostly noise.

FIG. 7(*d*) depicts a further slightly modified second adaptation of the third embodiment of the invention. In this further slightly modified adaptation, a fourth non-acoustic sensor, Non-acoustic Sensor 1*a*, is augmented to the three single-axis non-acoustic sensors, Non-acoustic Sensor 1, Non-acoustic Sensor 1*b* and Non-acoustic Sensor 1*c* in FIG. 7(*c*). This fourth non-acoustic sensor, Non-acoustic Sensor 1*a*, is the same Non-acoustic Sensor 1*a* in FIG. 7(*b*) and serves the same function—the first invented adaptation of the third embodiment of the invention. Specifically, in the x-axis, Non-acoustic Sensor 1*a* being further away from the user's mouth, it senses much more noise than Non-acoustic Sensor 1, and this much more noise signal from Non-acoustic Sensor 1*a* is used to cancel the noise sensed by Non-acoustic Sensor 1. This cancellation is obtained by signal processing in Electronic Device 20. To further accentuate further slightly modified second adaptation, the invented adaptations in FIGS. 6(*a*)-6(*f*) may be adopted for Non-acoustic Sensor 1 and Non-acoustic Sensor 1*a*.

FIG. 7(*e*) depicts the third adaptation of the third embodiment of the invention involving one single-axis non-acoustic sensor, Non-acoustic Sensor 1, and four acoustic microphones, Acoustic Microphone 10, Acoustic Microphone 10*a*, Acoustic Microphone 10*b* and Acoustic Microphone 10*c*. Note that in many contemporary smartphones, there are 3-4 acoustical microphones therein and they are often used for noise immunity based on prior-art techniques such as beamforming, noise reduction algorithms, etc., and often take advantage of their spatial locations. An example of this spatial location is the position of Acoustic Microphone 10 placed close to the mouth of the user and Acoustic Microphone 10*a* that is placed relatively far away from the mouth. These spatial positions are obtained by placements at various parts of the smartphone; see FIG. 8(*a*) later.

In this third adaptation of the third embodiment of the invention, the signal sensed by Non-acoustic Sensor 1 is mostly the user's voice at 0° azimuth and some noise at 180° azimuth along the x-axis (FIG. 7(*a*)). The ratio of the user's voice signal over noise sensed by Non-acoustic Sensor 1 would be much higher than that sensed by Acoustic Microphone 10 as Acoustic Microphone 10 is omni-directional (FIG. 2(*a*)) or slightly directional (FIG. 2(*b*)). Because of this improved signal-to-noise ratio obtained from Non-acoustic Sensor 1 over Acoustic Microphone 10, the signal processing in Electronic Device 20 would be able to provide improved noise immunity over the prior-art multiple-microphone system in contemporary smartphones.

A modified third adaptation of the third embodiment would be to employ one or more of the invented adaptations in second embodiment of the invention to Non-acoustic Sensor 1, i.e., one or more adaptations in FIG. 6(*a*)-(*f*). In this fashion, the noise sensed by Non-acoustic Sensor 1 at 180° azimuth is reduced.

Consider now the fourth embodiment of the invention where the Non-acoustic Sensor 1 is embodied in an electronic device or its attachment. In FIG. 8(*a*)-(*d*), Electronic Device 200 is preferably a smartphone or tablet that can be used for communications as a smartphone.

Contemporary electronic devices have several acoustic microphones, typically two or more, located at different locations within its enclosure. In the example of Electronic Device 200 depicted in FIG. 8(*a*), there are four acoustic microphones—Acoustic Microphone 202*a* in Acoustic Port 201*a*, Acoustic Microphone 202*b* in Acoustic Port 201*b*, Acoustic Microphone 202*c* in Earspeaker Port 201*c*, and Acoustic Microphone 202*d* in the back surface of Electronic Device 200.

In the first invented adaptation of the fourth embodiment of the invention, Electronic Device 200 in FIG. 8(*a*) further embodies Non-acoustic Sensor 1.

In contemporary electronic devices, this non-acoustic sensor is an accelerometer and not used for acoustic applications—it is used for ascertaining the orientation of the electronic device, movement and for navigational purposes. The various acoustic microphones are typically used for noise immunity in noisy environments, for example Acoustic Microphones 202*a* and 202*b* may be used for beamforming towards the mouth of the noise, and Acoustic Microphones 202*c* and 202*d* used for sensing mostly noise. A signal processor in contemporary electronic devices sample the output of these different microphones for acoustic noise cancellation, hence noise immunity.

In this first invented adaptation of the fourth embodiment of the invention, when Electronic Device 1 is used normally, it is oriented such that Earspeaker Port 201*c* is placed on, touches or pressed against on the pinna of the user, and Acoustic Microphone 202*a* (and Acoustic Microphone 202*b*, if present) is oriented to be close to the mouth of the user.

Unlike contemporary electronic devices where the non-acoustic sensor is not used for acoustic purposes, this invention conversely employs Non-acoustic Sensor 1 for acoustic purposes. Particularly, in this invention, it is applied to sense free-field vibrations or movement arising from the user's voice—as that described in the first embodiment of the invention in FIG. 4. To improve the directivity of Non-acoustic Sensor 1 towards the mouth of the speaker as depicted in FIG. 5(*b*) where the 0° azimuth is the direction towards the mouth, the various invented adaptations of the second embodiment of the invention depicted in FIG. 6(*a*)-(*f*) are applicable.

This second adaption of the fourth invention includes multiple Non-acoustic Sensors 1 similar to that described in the various adaptions of the third embodiments of the invention depicted in FIGS. 7(*b*)-(*d*). In this case where Electronic Device 1 is used normally, the other Non-acoustic Sensors 1*a*, 1*b* and 1*c* in FIG. 7(*b*)-(*d*) spatially placed at different parts of Electronic Device 1 are usually used to primarily sense noise while Non-acoustic Sensor 1 in FIG. 8(*a*) senses primarily voice and some noise. The signal processor in Electronic Device 1 processes two or more of the various outputs of these non-acoustic sensors, possibly including one or more acoustic microphones in Electronic Device 1, to obtain high noise immunity.

In some situations, one or more Non-acoustic Sensors 1*a*, 1*b* and 1*c* in FIG. 7(*b*)-(*d*) spatially placed at different parts of Electronic Device 1 can be used to conversely sense both voice and noise. For example, consider the case where Non-acoustic sensor 2*a* in FIG. 7(*b*) is placed in Earspeaker Port 201*c* in FIG. 8(*a*) and oriented or arranged to be sensitive to vibrations on or movement near the surface of Earspeaker Port 201*c*—note that this orientation is the same as Non-acoustic Sensor 1 and opposite to Non-acoustic sensor 1*a* depicted in FIG. 7(*b*). In a noisy environment, the user usually pushes Electronic Device 1 against his head, particularly pushing Earspeaker Port 201*c* in FIG. 8(*a*) against his pinna. In this fashion, Non-acoustic sensor 2*a* placed in Earspeaker Port 201*c* of Electronic Device 1 (not shown) can now sense vibrations on or movement around the user's head, including on the skin of the user's pinna, where the vibrations or movement resemble or arising from the user's voice.

FIG. 8(*b*) depicts the invented third adaptation of the fourth embodiment of the invention where Attachment 300 may be attached to Electronic Device 200 by means of Male Plug Connector 203*m* in Attachment 300 inserted into Female Socket Connector 203*f* in Electronic Device 200. In contemporary electronic devices, these connectors are typically the Micro-USB, USB-C or lightning connectors. In this third adaption, Non-acoustic Sensor 1 is now placed in the enclosure of Attachment 300. The function of Non-acoustic Sensor 1 in Attachment 300 in FIG. 8(*b*) is the same as Non-acoustic Sensor 1 in FIG. 8(*a*).

FIG. 8(*c*) depicts the invented fourth adaptation of the fourth embodiment of the invention where Attachment 300 now has Arm 304 that may be swung from a pivot. In this adaptation, Non-acoustic Sensor 1 is placed in Arm 304. In non-noisy environments, Arm 304 may be pushed into Cavity 305. In noisy environments, Arm 304 is swung open such that Non-acoustic Sensor 1 is now arranged to be placed closer to the mouth of the user to sense free-field vibrations or movements near the user's mouth. If Arm 304 is swung sufficiently, Non-acoustic Sensor 1 may now touch or press against the skin of the user—the region is close to the user's mouth. Non-acoustic Sensor 1 now senses the vibrations or movement on the skin surface close to the user's mouth.

FIG. 8(*d*) depicts the invented fifth adaptation of the fourth embodiment of the invention. In this adaption, Arm 304 and cavity 305 in FIG. 8(*c*) is now respectively Arm 204 and Cavity 205. Arm 204 and Cavity 205 are within the enclosure of Electronic Device 200, and they respectively serve the same function as Arm 304 and cavity 305 in FIG. 8(*c*).

The aforesaid descriptions are merely illustrative of the principles of this invention and many configurations, variations, and various modifications can be made by those skilled in the art without departing from the scope and spirit of the invention. The foresaid embodiments may be designed, realized and implemented individually or in any combination or permutations.

PATENT CITATIONS

| Cited Patent | Filing Date | Publication Date | Applicant | Title |
|---|---|---|---|---|
| U.S. Pat. No. 4,607,383 | Aug. 18, 1983 | 19 Aug. 1986 | Robert Ingalls | Throat microphone |
| U.S. Pat. No. 3,787,641 | 5 Jun. 1972 | 22 Jan. 1974 | Santori C | Bone conduction microphone assembly |
| US 20050244020 A1 | 1 Sep. 2003 | 3 Nov. 2005 | Yoshitaka Nakajima, Makoto Shozakai | Microphone and communication interface system |
| US 20100172519 A1 | 8 Dec. 2009 | 8 Jul. 2010 | Tominori Kimura | Bone-conduction microphone built-in headset |
| U.S. Pat. No. 5,282,253 | 26 Feb. 1991 | 25 Jan. 1994 | Masao Konomi | Bone conduction microphone mount |
| U.S. Pat. No. 9,363,596 | 15 Mar. 2013 | 7 Jun. 2016 | Sorin V Dusan, Aram Lindahl, Esge B. Anderson | System and method of mixing accelerometer and microphone signals to improve voice quality in a mobile device |

The invention claimed is:

1. A transducer apparatus comprising a transducer that directly senses free-field acoustical sounds where said free-field acoustical sounds include that which resemble or arise from the voice of the user, and said transducer is a non-acoustic sensor including an accelerometer, or shock sensor, or gyroscope, or vibration microphone, or vibration sensor, is sensitive to free-field acoustical signals to at least 500 Hz, is a single-axis device, and whose sensitivity is directional in said single-axis.

2. A transducer apparatus according to claim 1 where said transducer is arranged such that said transducer may be oriented in any direction, including in a direction where it is most sensitive to said vibrations or movements.

3. A transducer apparatus according to claim 2 where said transducer having a front-surface and a back-surface, and is adapted to be more sensitive to vibrations on or movements around said front-surface than in said back-surface, or in one direction than other directions.

4. A transducer apparatus according to claim 3 where
said transducer is placed in an enclosure,
said enclosure has a front-wall with an inner-front-surface, and
said front-surface touches or adhered to said inner-front-surface.

5. A transducer apparatus according to claim 4 where
said enclosure further has a back-wall, and a gap exists between said back-surface and said back-wall.

6. A transducer apparatus according to claim 5 where
said enclosure is adapted such that for a given vibration or movement, said transducer is more sensitive to vibrations on or movement around said front-wall than said back-wall.

7. A transducer apparatus according to claim 5 where
said back-wall has an inner-back-surface, and
at least one piece of compliant material is placed between said back-surface and said inner-back-surface.

8. A transducer apparatus according to claim 3 where
said transducer having a back-surface and placed in an open cavity enclosure without a back-wall, and
at least one or more pieces of compliant material touching or adhered to said back-surface and covering part of or the entire said back-surface.

9. A transducer apparatus according to claim 3 where
a material is placed in front of or on said front-surface, and
said material increases the sensitivity of said transducer, including vibrations on or movement perpendicular to said front-surface.

10. A transducer apparatus according to claim 1 further having a second transducer, where
said transducer and said second transducer each having a front-surface,
said transducer is arranged such that its said front-surface is oriented to sense vibrations resembling or arising from said voice, and
said second transducer is arranged such that its said front-surface is oriented in a direction different from that of said front-surface of said transducer, including one or more of the following orientations:
(i) opposite to the orientation of said front-surface of said transducer,
(ii) away from the mouth of said user, or
(iii) approximately perpendicular or perpendicular to the orientation of said front-surface of said transducer.

11. A transducer apparatus according to claim 1 further having a multiplicity of transducers, where
said transducer and each of said multiplicity of transducers having a front-surface, and
said transducer and every transducer in said multiplicity of transducers are arranged such that said front-surface of any transducer is oriented in a direction different from said front-surface of every other said transducer.

12. A transducer apparatus according to claim 1 further comprising a second transducer, where
both said transducer and said second transducer are oriented to be sensitive to said vibrations or movements, and
said second transducer is arranged to be placed further away from the mouth of said user than said transducer.

13. A transducer apparatus according to claim 1 further comprising only a second transducer, or second and third transducers, or second and third and fourth transducers, where
said transducer is oriented to be sensitive to said vibrations or movements, and in the case of said only second transducer, said only second transducer is oriented to be approximately perpendicular or perpendicular to said transducer,
in the case of the said second and third transducers, said second and third transducers are oriented such that they are approximately perpendicular or perpendicular to said transducer and to each other, and
in the case of second, third and fourth transducers, said second is arranged to be oriented in the same direction as said transducer but placed further away from the mouth of said user, and said second and third transducers are oriented such that they are approximately perpendicular or perpendicular to said transducer and to each other.

14. A transducer apparatus according to claim 13 where
said transducer and said second transducer, or said transducer and said second transducer and said third transducer, are collectively either a single transducer with two sensors, or a single transducer with three sensors, where
each sensor is sensitive to vibrations or movements in one of three perpendicular directions.

15. A transducer apparatus according to claim 11 where every transducer having a back-surface, and for at least one transducer, it is more sensitive to vibrations on its said front-surface than on its said back-surface, or movement near its said front-surface than near its said back-surface.

16. A transducer apparatus according to claim 1 further comprising
at least an acoustic microphone placed close to the mouth of said user and having an acoustical input port arranged to be orientated to
where said transducer is sensitive to said vibrations or movement, or towards the surface of said mouth.

17. A transducer apparatus according to claim 16 further comprising a second acoustic microphone having an acoustical input port, where
said second acoustic microphone is arranged to be placed further from said mouth than said at least acoustic microphone, and
said acoustic input port of second acoustic microphone is orientated in a direction approximate opposite or opposite to said acoustic input port of said at least acoustic microphone.

18. A transducer apparatus according to claim 1 further comprising a multiplicity of acoustic microphones, where
each acoustic microphone having an acoustical input port,
one acoustic microphone is placed close to said user's mouth with its acoustic port oriented to point to or approximately to the mouth of said user, and
the remaining acoustic microphones of said multiplicity of acoustic microphones are arranged as follows:
(i) another acoustic microphone is placed either
(a) further away than said one acoustic microphone from said user's mouth with its said acoustic port oriented to point approximately opposite or opposite to that of said acoustic port of said one acoustic microphone, or
(b) with its said acoustic port oriented to point approximately perpendicular or perpendicular to that of said acoustic port of said one acoustic microphone,
(ii) other acoustic microphones oriented such that their acoustic input ports are oriented to point approximately perpendicular or perpendicular to every other acoustic microphone.

19. A transducer apparatus according to claim 10 where at least two transducers are arranged or oriented to sense different levels of voice and noise.

20. A transducer apparatus according to claim 18 where said another acoustic microphone is arranged or oriented such that its arrangement or orientation is the same as said acoustic microphone or said first acoustic microphone, respectively.

21. A transducer apparatus according to claim 1, wherein the non-acoustic sensor having a front-surface and a back-surface is configured to reduce noise by one or more of placing or adhering a backing to the back surface of the non-acoustic sensor or at least partially encapsulating the non-acoustic sensor in an enclosure.

22. A transducer apparatus according to claim 1, wherein said transducer is arranged to be oriented such that the highest sensitivity direction is pointed to the user's mouth.

23. A transducer apparatus according to claim 22, wherein the signal-to-noise of the acoustical sounds of the user's voice sensed by the transducer is higher than when the transducer is arranged to be oriented to another direction.

* * * * *